US005158629A

United States Patent [19]

Zobbi

[11] Patent Number: 5,158,629

[45] Date of Patent: Oct. 27, 1992

[54] REDUCING SURFACE ROUGHNESS OF METALLIC OBJECTS AND BURNISHING LIQUID USED

[75] Inventor: Robert G. Zobbi, Southbury, Conn.

[73] Assignee: Rem Chemicals, Inc., Southington, Conn.

[21] Appl. No.: 397,236

[22] Filed: Aug. 23, 1989

[51] Int. Cl.[5] ..... B24B 1/04; C23F 1/00; C23F 3/02

[52] U.S. Cl. ..... 156/628; 156/638; 156/645; 151/316; 151/317; 134/4; 134/7; 134/25.1; 134/29; 134/32

[58] Field of Search ..... 156/628, 638, 645; 51/316, 317, 318; 134/29, 32, 40, 41, 3, 25.1, 26, 4, 7, 22.17

[56] References Cited

U.S. PATENT DOCUMENTS 4,284,252 8/1981 Leikhim et al. ..... 252/528
4,806,266 2/1989 Burrill ..... 252/140

*Primary Examiner*—David L. Lacey
*Assistant Examiner*—Todd J. Burns
*Attorney, Agent, or Firm*—Ira S. Dorman

[57] ABSTRACT

A physicochemical process for refining metal surfaces which includes the steps of introducing metallic objects to be refined and a solution capable of reacting with the metal to produce a softer phosphate or oxalate conversion coating on the metal surface into a finishing unit for agitation. Agitation is carried out to produce movement among the metallic objects for conversion of the metallic surface by the solution. The mechanical and chemical action achieves a reduction in the surface roughness of the metallic objects. A burnishing step is carried out by agitating the metallic objects with a burnishing liquid to remove the conversion coating and to achieve a specular finish. The burnishing liquid contains 0.01 to 1.5 weight percent of a phosphate compound and 0.002 to 0.2 weight percent of an organic slip agent and is used at a pH of 8.5 to 10.5. The low organic content of the burnishing liquid produces a waste stream having a low oxygen demand for waste treatment facilities. Optionally, high density, non abrasive particles may be used during the conversion and burnishing steps to help in reducing surface roughness and removal of the conversion coating.

17 Claims, No Drawings

REDUCING SURFACE ROUGHNESS OF METALLIC OBJECTS AND BURNISHING LIQUID USED

BACKGROUND OF THE INVENTION

A physicochemical process for refining metal surfaces is described and claimed in Michaud et al U.S. Pat. No. 4.491,500, issued Jan. 1, 1985, which process involves the development, physical removal and continuous repair of a relatively soft coating on the surface. High points are leveled through mechanical action, preferably developed in vibratory mass finishing apparatus, and very smooth and refined surfaces are ultimately produced in relatively brief periods of time The patentees teach that the process can be carried out using either a part-on-part technique or by incorporating an abrasive mass finishing media; e.g., quartz, granite, aluminum oxides, iron oxides, and silicon carbide, which may be held Within a matrix of porcelain, plastic, or the like. As described therein, the effectiveness of the process is evidently attributable to the selective removal of surfaces irregularities, Which removal has been facilitated by chemical conversion of the metal to a softer form.

To achieve ultimate refinement of the metal surface, it will generally be desirable to finish the Michaud et al process with a burnishing step, which may be carried out by treatment of the parts in a mass finishing unit charged with a so-called burnishing media and an aqueous alkaline soap solution, the latter being inert to the metal. Such burnishing media will typically be composed of mineral oxide grains fused to a hard, dense, non-abrasive cohesive mass; it is also commonly known to use steel balls for burnishing metal parts.

The process described by Michaud et al can be employed to produce burnished parts without transferring them to a second bowl, by using a relatively nonaggressive cutting medium (e.g., a ceramic containing 10 to 15 percent of abrasive grit). In such a procedure the initial, surface-refinement phase is carried out with a reactive solution which produces the conversion coating on the parts, generally followed by a flushing step and then, with the equipment in operation, a flow of a burnishing soap solution.

Although highly advantageous, such a method may not produce specular brightness, since it is characteristic of abrasive media that they scratch the metal surfaces. In Michaud U.S. Pat. No. 4,818,333, issued Apr. 4, 1989, a physicochemical process is provided for refining metal surfaces to a condition of high smoothness and brightness, in relatively brief periods of time and without need for removal of the objects or the media from the container of the mass finishing unit. The process is characterized by the use of a non-abrasive, high-density burnishing media throughout the entire surface-refining and burnishing operation.

As indicated, the physicochemical refinement methods described in the foregoing patents involve the formation of a conversion coating on the metal surface, which is ultimately removed in the burnishing step. Because that occurs primarily through physical contact, however, some of the coating frequently remains in sheltered or recessed areas. This is of course undesirable for self-evident reasons, especially if the part is to electroplated, varnished, or otherwise surface coated.

At present, hydrochloric acid is widely used to dissolve such residual conversion coatings, but that practice is undesirable for a number of reasons, particularly the tendency of HCl to cause hydrogen embrittlement. Other chemical formulations have been employed for the dissolution of oxalate and phophate coatings, but they are typically characterized by relatively high levels of organic component content; thus, they disadvantageously add to the oxygen demand made upon available waste treatment facilities, and in some cases their use is prohibited as a result.

The Prior art of course discloses numerous chemical formulations for cleaning metal surfaces, many of which employ a phosphate compound as the primary active ingredient. For example, Crowther U.S. Pat. No. 2,986,526, issued May 30, 1961, discloses metal-cleaning compositions which comprise an alkali metal pyrophosphate and a higher aliphatic fatty alcohol/ethylene oxide reaction product; tetrasodium pyrophosphate is deemed to provide the best result, and is preferred. In accordance with the patent, a granular product is made by absorbing the ethylene oxide/-alcohol adduct into the pyrophosphate, at ratios in the range of 0.5–10:-90–99.5, and the product is dissolved in water at a concentration of 0.5 to 10 percent and to provide a working solution with a pH of preferably 9.0 to 10.0.

Copson U.S. Pat. No. 3,325,244, issued June 13, 1967, and Van Kampen et al U.S. Pat. No. 3,370,015, issued Feb. 20, 1968, disclose cleaning compositions in Which a pyrophosphate is the major ingredient. Cinamon, Kelly et al and Sopp, Jr. disclose, in U.S. Pat. Nos. 2,481,977, 3,210,278 and 3,655,467, issued Sept. 13, 1949, Oct. 5, 1965 and Apr. 11, 1972, respectively, compositions containing a pyrophosphate and another alkaline detergent builder. Phosphate cleaning compositions are also taught by Schaeffer, Highfill, and Dupre et al, in U.S. Pat. Nos. 2,618,604, 4,803,058, 3,145,178 and 3,312,624, issued Nov. 18, 1952, Feb. 7, 1989, Aug. 18, 1964, and Apr. 4, 1967, respectively.

Despite the activity in the art indicated by the foregoing, a need remains for a burnishing composition and mass finishing method by which metal-surfaced objects can be refined using a physicochemical technique, and can subsequently be burnished while simultaneously effecting the removal of any residual conversion coating. It is therefore the broad object of the present invention to provide a novel composition and method for achieving those results.

It is a more specific object of the invention to provide a novel composition and method by which such residual coatings can readily be removed from areas of metal surfaces that are recessed, or are for other reasons inaccessible to contact by solid elements employed in a mass finishing process Other more specific objects are to provide such a composition and method by which the workpiece surfaces can be brought to a condition of specular brightness, in a desirably brief period of time and without etching or other adverse effect upon surface quality.

An especially important object of the invention is to provide a composition and method having the foregoing features and advantages, which produces a waste stream having a low chemical oxygen demand characteristic, and which is relatively easy to treat for the recovery of dissolved metal compounds.

A further object of the invention is to provide a novel burnishing composition composed of ingredients that are readily available and relatively inexpensive, which can be prepared in stable, concentrated form so as to make transport and use convenient and economical.

SUMMARY OF THE INVENTION

It has now been found that certain of the foregoing and related objects of the invention are attained by the provision of a surface-refinement and burnishing process in which a mass of elements, including a quantity of objects having relatively rough metal surfaces, and a solution capable of reacting with the metal of the surfaces to produce an oxalate or a phosphate conversion coating of softer form thereon, are introduced into the container of a mass finishing unit and are agitated therein. Agitation is carried out to produce relative movement among the elements, and to maintain the surfaces in a wetted condition with the solution, for conversion of any metal exposed thereon; it is continued for such a period of time so as to effect, by chemical and mechanical action, a significant reduction in surface roughness. Thereafter, the mass of elements is so agitated with an aqueous liquid that is at least substantially inert to the metal, to effect removal of the conversion coating and substantial burnishing of the refined surfaces. As used in the process, the aqueous liquid contains about 0.01 to 1.5 weight percent of a phosphate compound and up to about 0.2 Weight percent of an organic slip agent, and it has a pH of about 8.5 to 10.5. The phosphate compound is selected from the class consisting of water-soluble tetrapyrophosphate and hexametaphosphate salts, and the slip agent is adherent to the metal surfaces at the existing pH, so as to provide lubricity thereto; preferably, the total concentration of organic constituents contained in the aqueous burnishing liquid will not exceed about 0.1 percent by weight of the liquid, and most desirably it will be at a level of 0.05 percent by weight thereof, or lower.

Preferred concentrations of ingredients in the burnishing liquid, as prepared for use in the process, are about 0.5 to 1.0 weight percent of the phosphate compound and about 0.002 to 0.05 weight percent of the slip agent. Potassium tetrapyrophosphate is preferred as the phosphate ingredient, and the slip agent surfactant employed will usually be an amphoteric tertiary amine containing at least one fatty chain, of 5 to 20 carbon atoms, and an active group selected from carboxylate and sulfonate groups. The slip agent will desirably be a compound selected from the class consisting of imidazoline derivatives, betaines, sultains and aminopropionates.

Best results will usually be realized when the process is carried out with the mass of elements subjected to vibratory action in an open vessel, to produce the necessary agitation and desirable oxygenation, and with the solution and liquid burnishing compound being supplied to the vibratory mass finishing unit on a flow-through basis. The mass of elements employed in the process will usually include a quantity of abrasive or (preferably) nonabrasive solid media elements for assisting in the removal of the conversion coating from the metal surfaces during the period of agitation. Typically, the quantity of objects and the quantity of media elements will be present in the mass of elements in a volumetric, objects:media ratio of about 0.1 to 3:1, and the relatively rough metal surfaces to be refined will have an arithmetic average roughness (Ra) value of about 20 to 100 microinches (about 0.5 to 2.5 micrometers), that value desirably being reduced during the refinement phase of the process to an arithmetic average roughness value of about 4 microinches (0.1 micrometer), and most desirably about 2 microinches (0.05 micrometer) or lower, the roughness values being those that would be determined using a "P-5" Hommel Tester or equivalent apparatus. In most instances, the solution employed will be formulated to produce an oxalate conversion coating in reaction with the surface metal, which metal will generally be of ferrous composition, but may also be brass or the like. The process is employed to particualr benefit for objects having surfaces that include areas that are recessed, or that are otherwise rendered substantially inaccessible for contact by solid media elements. It is also advantageous in enabling such results to be achieved with the mass of elements remaining in the container of the mass finishing unit throughout the entire period of the procedure, and in achieving specular surfaces under those conditions.

Other objects of the invention are attained by the provision of an aqueous burnishing liquid comprised as hereinabove defined, and by the provision of an aqueous liquid concentrate that is suited for dilution to produce such a burnishing liquid. The concentrate will comprise water, 5 to 725 grams per liter of water of a water-soluble phosphate compound selected from tetrapyrophosphate and hexametaphosphate salts, and about 1 to 60 grams per liter of water of a slip agent; preferably the amount of slip agent will be in the range 2 to 30 grams per liter, and the components of the concentrate may otherwise be varied in accordance with the disclosure set forth hereinabove and hereinbelow.

Exemplary of the efficacy of the present invention is the following specific example:

EXAMPLE ONE

An aqueous solution is prepared from a mixture of 80 weight percent oxalic acid, 19.9 weight percent sodium tripolyphosphate, and 0.1 weight percent sodium lauryl sulfonate, the mixture being dissolved in water at a concentration of 60 grams per liter thereof. The bowl of a vibratory mass finishing unit, of straight-wall, open-top form and having a capacity of about 113 liters, is substantially filled with solid media and 115 wrenches, the latter being made of hardened, high-carbon steel and having handles that are knarled to provide a cross-hatch pattern with relatively deep recessed areas; flat areas are also present on the wrenches.

The media employed is commercially available as a burnishing media, and is preconditioned, as necessary to remove sharp edges. It is the composition designated media "D" in the above-mentioned Michaud U.S. Pat. No. 4,818,333, nominally composed of aluminum (77%), silicon (11%), iron (7%) and titanium (5%), on an oxygen-free basis, with grains about 1 to 25 microns in maximum dimension and of mixed platelet and granular shape. The elements of the media comprise a mixture of approximately equal amounts of cylinders, measuring about 1.3 cm in diameter, and flat triangles measuring about 1.0 cm on a side; they have a density of about 3.3 g./cm$^3$, and a diamond pyramid hardness value of about 1130, as determined by ASTM method E-384 using a 1000 gram load and averaging three readings; the mass of elements has a bulk density of about 2.3 g./cm$^3$.

The vibratory finishing unit is operated for two hours at about 1,300 revolutions per minute and at an amplitude setting of 4 millimeters. The surface conversion solution is added at room temperature and on a flow-through basis (i.e., fresh solution is continuously introduced and used solution is continuously drawn off and discarded), at the rate of about 7.5 liters per hour.

At the end of the refinement phase a heavy, black iron oxalate coating remains on the wrenches. Although not normally required as a practical matter, the bowl is flushed with twenty liters or so of the burnishing liquid that is to be employed in the second phase of the test. The wrenches are thereafter subjected to treatment for two hours under the same conditions as are employed in the first phase of the test, using however a liquid flow-through rate of about 44 liters per hour.

Burnishing liquids of differing composition are employed in each of three runs, at the end of which the parts are inspected to assess effectiveness of removal of the black conversion coating from the recesses of the knarled areas, and also to evaluatele brightness on the flat surfaces. In all instances the oxalate coating is found to have been removed entirely from the knarled areas in about 35 minutes of actual burnishing, and the surfaces exhibit an Ra value of about 2 to 4 microinches (about 0.05 to 0.1 micrometers).

Part A

The burnishing liquid contains 7.2 grams per liter of potassium tetrapyrophosphate (TKPP), 0.03 gram per liter of oleic acid, and 0.4 gram per liter of cocoamphocarboxypropionate (a commercial product sold by Miranol, Inc. under the trademark MIRANOL C2M-SF), the balance being water; it has a pH of 9.8. The flat areas on the wrenches exhibit a high degree of brightness.

Part B

The burnishing liquid contains 7.2 grams per liter of TKPP, 0.014 gram per liter of sodiumlauryl sulfate, and 0.19 gram per liter of MIRANOL C2M-SF; its pH is 9.8. The flat areas are brighter than those produced on the wrenches treated with the burnishing compound of Part A.

Part C

The burnishing liquid contains 7.2 grams per liter of TKPP, 0.38 gram per liter of MIRANOL C2M-SF, and 0.017 gram per liter of a nonylphenoxypoly(ethyleneoxy)ethanol surfactant (commercially available from GAF Chemicals Corporation under the trademark IGEPAL CO-710); the pH value is 9.8. The brightness level exhibited on the flat areas is somewhat higher than in Part B hereof.

The principal ingredient of the burnishing liquid employed in the practice of the invention is a water-soluble tetrapyrophosphate or hexametaphosphate salt. The preferred compound, from the standpoint of speed of reaction as well as solubility in the concentrated form, is potassium tetrapyrophosphate. However, sodium tetrapyrophosphate and sodium hexametaphosphate may also be utilized, albeit less advantageously, and other phosphates, such as sodium acid phosphate and sodium tripolyphosphate, may be employed in combination with the foregoing. It has been found that aqueous solutions containing only a specified phosphate component (and especially potassium tetrapyrophosphate) are effective to remove the black oxalate coating from ferrous metal surfaces under the agitation conditions described, and to do so without causing pitting or other chemical attack. Although appropriate concentrations of the phosphate component have been specified hereinabove, it might be noted that the lower limit stated is significant not only from the standpoint of providing adequate activity in dissolving the conversion coating, but also to avoid phosphating of the metal surface, which will tend to occur at phosphate compound concentrations below about 0.01 weight percent of the liquid. Such a result would obviously be unacceptable in the practice of the invention, since a primary objective is to remove all extraneous coatings that might interfere with plating or other surface treatment.

The organic slip agent included in the burnishing liquid is effective to maximize the level 1 of brightness produced, and to minimize microscopic scratching of the surface. Generic definitions of suitable agents have been set forth hereinabove; among the specific compounds that may advantageously be used as the slip agent constituent are the following:

(1) as amphoteric carboxylated imidazoline derivatives, cocoamphoglycinate, cocoamphopropionate, cocoamphocarboxyglycinate, cocoamphoboxypropionate, lauroamphoglycinate, lauroamphocarboxyglycinate, lauroamphocarboxypropionate, caproamphoglycinate, caproamphocarboxyglycinate, caproamphocarboxypropionate mixed amphocarboxylates containing 8 carbon atoms in the fatty chain, capryloamphocarboxyglycinate, capryloamphocarboxypropionate, tallamphopropionate, tallamphocarboxypropionate, stearoamphoglycinate, isostearoamphopropionate, cocoamphocarboxypropionic acid, lauroamphocarboxypropionic acid, mixed amphocarboxylic acid, containing 8 carbon atoms in the fatty chain and cocoamphocarboxypropionic acid;

(2) as amphoteric sulfonated imidazoline derivatives, cocoamphopropylsulfonate, lauroamphopropylsulfonate, oleoamphopropylsulfonate, capryloamphopropylsulfonate, and stearoamphopropylsulfonate;

(3) as amphoteric betaines, cocamidopropyl betaine, oleamidopropyl betaine, coco-betaine, oleyl betaine, and dihydroxyethyl tallow glycinate;

(4) as amphoteric sultaines, cocamidopropyl hydroxysultaine and tallowamidopropyl hydroxysultaine; and (5) as aminopropionates, disodium lauriminodipropionate, sodium lauriminodipropionate, and disodium tallowiminodipropionate. It is believed that the slip agents employed are of such a nature as to be cationic to the metal surface at the prevailing pH, so as to adsorb thereon and afford lubricity thereto. It is important however that the tenacity of bonding not be so great as to preclude relatively facile removal of the slip agent, since that would interfere with subsequent treatment of the metal surface.

Although the specified slip agents are effective alone to produce the desired lubricity, it may sometimes be beneficial to include secondary surfactants in combination with them; for example, the sodium lauryl sulfate and ethylene oxide/alcohol adduct employed in Parts B and C, respectively, of Example One are used to good effect. It is believed that the secondary surfactants function synergistically with the primary surfactants specified, and that they are effective because they exhibit marginal solubility in the system while, nevertheless, being stable in solution; normally, those compounds would be employed in the amounts set forth, or in somewhat lower concentrations. In some instances, ingredients such as methanol, xylene sulfate, or the like may also desirably be included in the formulation to enhance solubility. It should be borne in mind however that a primary attribute of the burnishing compounds provided in accordance with the Present invention resides in the very low concentrations of organic constituents that they employ; i.e., about 0.1 weight percent or less based upon the working solution. It should also be borne in mind that the incorporation of excessive amounts of surfactants may lead to solubility problems (particularly in the concentrate) and to excessive foaming, as would tend to interfere with efficient operation. The balance of the burnishing liquids, apart from the ingredients specified, will of course consist substantially entirely of water.

In its concentrated !form, the burnishing liquid will of course contain a minimum proportion of water, as a matter of economics and convenience of transport. On the other hand, high concentrations of the ingredients will tend to cause instability, with either the phosphate or the organic constituents becoming insoluble in the aqueous phase, depending to an extent upon the specific ingredients employed. Thus, when potassium tetrapyrophosphate is utilized the limiting factor will generally be the organic material; that is, when present in an appropriate ratio to the phosphate, the organic constituent will usually become insoluble first.

The concentrate will normally be so formulated that admixture of about 1 to 3 percent by weight thereof with water will produce the working burnishing liquid. It goes without saying that the dilution level must be sufficient to provide adequate strength of the ingredients; moreover, use of a liquid that is overly dilute will require an excessive flow rate through the mass finishing unit. To be deemed effective as a practical matter, the concentrations of active ingredients should be adequate to effect removal of the conversion coating from the objects in a period of one hour or less, and preferably in about one-half hour. In some instances however the rate of dissolution may be somewhat slower, and a period as long as two hours may be considered satisfactory under certain circumstances.

The pH value of the burnishing liquid has a significant effect upon the results produced. Generally, the pH should be in the range 8.5 to 10.5, although some deviation from those values may nevertheless produce satisfactory results. Should it be desirable to do so, pH adjustment can be made utilizing any appropriate reagent, such as potassium hydroxide or phosphoric acid.

It is also believed that oxygenation is important to the proper functioning of the burnishing liquids. The conditions necessary are inherently satisfied in carrying out the process of the invention, wherein either an open or vented vibratory unit, or equivalent piece of mass finishing equipment, will be utilized.

An aspect that is essential in certain embodiments of the invention is of course the utilization of a solution for converting the surfaces of the workpieces to a reaction product that is more easily removed than is the basis metal. This general concept is fully disclosed in the abovementioned Michaud et al patent, and the formulations described therein can be utilized to good effect in the practice of the present invention Other formulations that are highly effective for the same purpose are described and claimed in Zobbi et al U.S. Pat. No. 4,705.594. issued Nov. 10, 1987. The disclosures of the Michaud et al and Zobbi et al patents are hereby incorporated hereinto by reference, as appropriate to teach specific formulations for producing suitable conversion coatings. From the foregoing, and from the information herein set forth, it will be appreciated that a wide variety of compositions can be employed in the practice of the present invention, and the selection or development of specific formulations will be evident to those skilled in the art based thereupon.

As indicated above, not only may the media elements be abrasive or nonabrasive, but they may also take a wide variety of sizes and shapes. Thus, they may be angle-cut cylinders, they may be relatively flat pieces that are round, rectangular or triangular, or they may be of indefinite or random shapes and sizes. Generally, the smallest dimension of the dense media elements referred to herein will not be less than about 0.6 cm, and the largest dimension will usually not exceed about 3 cm. The size and configuration of the elements that will be most suitable for a particular application will depend upon their density and upon the weight, dimensions and configuration of the workpieces, which will also indicate the optimal ratio of parts-to-media, as will be evident to those skilled in the art.

In regard to the latter, an important function of the media is to ensure that the parts slide over one another, and that direct, damaging impact thereamong is minimized. Consequently, when the parts are relatively large and are made of a highly dense material a high proportion of media will be employed; e.g., a media:-parts ratio of about 10:1, or even greater in some instances. On the other hand, when the workpieces are relatively small and light in weight they develop little momentum in the mass finishing apparatus, and consequently a ratio of parts-to-media of about 3:1 may be suitable.

The preferred media for use in the instant process is the high-density, non-abrasive media described in Michaud U.S. Pat. No. 4,818,333. The disclosure of that patent is hereby incorporated hereinto by reference, insofar as it describes such media and the use thereof.

Although other kinds of mass finishing equipment, such as vented horizontal or open-mouth barrels, and high-energy centrifugal disc machines, may be used, the process of the invention will most often be carried out in an open-top vibratory finishing unit. Typically, the unit will be operated at 800 to 1,5000 rpm and at an amplitude of 1 to 8 millimeters; preferably, however, the amplitude setting will be at 2 to 4 millimeters The unrefined metal surfaces of objects finished in accordance with the instant process may have an arithmetic average roughness value of 100 microinches (about 2.5 micrometers) or so, and can be refined by the process to a roughness value which is about 4 microinches (about 0.1 micrometer), and most desirably about 2 microinches (about 0.05 micrometer), or lower. Perhaps it should be pointed out that "arithmetic average roughness" expresses the arithmetic mean of the departures of the roughness profile from the mean line. Generally, the refinement procedure will require less than about ten hours, and in the preferred embodiments ultimate surface smoothness will be achieved in seven hours or less.

The reactive solution and the burnishing liquid will normally be introduced into the mass finishing unit at room temperature, and may be utilized in any of several flow modes; best results will often be attained however by operating on a continuous flow-through basis, as described above. Alternatively, the solution and liquid may be employed in a batchwise manner, or they may be recirculated through the equipment if so desired.

Thus, it can be seen that the present invention provides a novel burnishing composition, and mass finishing method, by which metal-surfaced objects can be refined using a physicochemical technique, and can subsequently be burnished while simultaneously effecting the removal of residual conversion coating from the objects. More specifically, the composition and method of the invention enable the removal of such residual coatings from areas of the metal surface that are recessed, or are for other reasons inaccessible to contact by a solid element employed in a mass finishing process, and the surfaces can be brought to a condition of specular brightness in a desirably brief period of time and without etching or other adverse effect upon quality. An especially important benefit is that the invention provides a composition and method which produces a waste stream having a low chemical oxygen demand characteristic, and that is relatively easy to treat for the recovery of dissolved metal compounds. Furthermore, the burnishing liquid provided is composed of ingredients that are readily available and relatively inexpensive, and that can be prepared in the form of stable concentrates so as to make transport and use convenient and economical.

Having thus described the invention, what is CLAIMED is:

1. In a process for the physicochemical refinement and burnishing of metal surfaces of objects, in which a mass of elements including a quantity of objects having relatively rough metal surfaces, and a solution capable of reaction with the metal of said surfaces to produce an oxalate or a phosphate conversion coating of softer form thereon, are introduced into a container of a mass finishing unit and are agitated therein for a period of time to produce relative movement among said elements and to maintain said surfaces in a wetted condition with said solution, for conversion of any metal exposed thereon, on a continuous basis, so as to thereby effect a significant reduction in roughness by chemical and mechanical action; and in which said mass of elements is thereafter so agitated in said unit with an aqueous liquid that is at least substantially inert to said metal, to effect removal of said conversion coating and substantial burnishing of the refined surfaces; wherein the improvement comprises said aqueous liquid containing about 0.01 to 1.5 weight percent of a phosphate compound selected from the class consisting of water-soluble tetrapyrophosphate and hexametaphosphate salts, and about 0.002 to 0.2 weight percent of an organic slip agent, said liquid having a pH of about 8.5 to 10.5 and said slip agent being adherent to said metal surfaces at said pH so as to provide lubricity thereto.

2. The process of claim 1 wherein said surfaces are of ferrous metal composition, and wherein said solution produces an iron oxalate conversion coating in reaction with said metal of said surfaces

3. The process of claim 1 wherein the total concentration of organic constituents in said aqueous liquid is not in excess of 0.1 percent by weight of said liquid.

4. The process of claim 1 wherein said aqueous liquid contains about 0.5 to 1.0 weight percent of said phosphate compound, and no more than about 0.05 weight percent of said slip agent.

5. The process of claim 1 wherein said slip agent is amphoteric.

6. The process of claim 1 wherein said slip agent is a compound selected from the class consisting of imidazoline derivatives, betaines, sultains and aminopropionates.

7. The process of claim 1 wherein said phosphate compound is potassium tetrapyrophosphate.

8. The process of claim 6 wherein said slip agent is an amphoteric imidazoline derivative.

9. The process of claim 1 wherein said aqueous liquid additionally includes a small amount of a secondary surfactant.

10. The process of claim 1 wherein said process is carried out with said mass of elements subjected to vibratory action to produce said agitation, wherein said solution, and subsequently said liquid, are supplied to said unit on a flow-through basis, and wherein said solution and liquid are oxygenated by said agitation.

11. The process of claim 10 wherein said mass of elements includes a quantity of solid media elements for assisting in the removal of said conversion coating from said surfaces during said agitation period.

12. The process of claim 11 wherein said media is of high density, non-abrasive character, and wherein said quantity of objects and said quantity of media elements are present in said mass of elements in a volumetric, objects:media ratio of about 0.1 to 3:1.

13. The process of claim 12 wherein said relatively rough metal surfaces have an arithmetic average roughness value of at least about 20 microinches (about 0.5 micrometers), wherein said significant reduction produces a surface with an arithmetic average roughness value of about 4 microinches (about 0.1 micrometer) or less, and wherein said period of time is less than about 10 hours, said arithmetic average roughness values being those that would be determined using a "P-5" Hommel Tester or equivalent apparatus.

14. The process of claim 10 wherein said agitation is carried out in a vibratory mass finishing unit operating at an amplitude of 2 to 4 millimeters.

15. The process of claim 1 wherein said surfaces include recessed areas that are substantially inaccessible for contact by said solid media elements.

16. The process of claim 1 wherein said process burnishes said metal surfaces to a specular condition.

17. The process of claim 1 wherein said solution, and thereafter said liquid, are supplied sequentially to said container, said mass of elements remaining therein throughout said process.

* * * * *

UNITED STATES PATENT AND TRADEMARK OFFICE

CERTIFICATE OF CORRECTION

PATENT NO. : 5,158,629

DATED : October 27, 1992

INVENTOR(S) : Robert G. Zobbi

It is certified that error appears in the above-identified patent and that said Letters Patent is hereby corrected as shown below:

On the title page, in the listing of "References Cited U.S. PATENT DOCUMENTS" add the following:

| | | | |
|---|---|---|---|
| -- 2,481,977 | 9/1949 | Cinamon | 117/127 |
| 2,618,604 | 11/1952 | Schaeffer | 252/135 |
| 2,986,526 | 5/1961 | Crowther | 252/135 |
| 3,145,178 | 8/1964 | Dupre' | 252/137 |
| 3,210,287 | 10/1965 | Kelly | 252/139 |
| 3,312,624 | 4/1967 | Dupre' | 252/139 |
| 3,325,244 | 6/1967 | Copson | 23/107 |
| 3,370,015 | 2/1968 | VanKampen | 252/137 |
| 3,655,467 | 4/1972 | Sopp, Jr. | 156/22 |
| 4,491,500 | 1/1985 | Michaud et al | 156/628 |
| 4,705,594 | 11/1987 | Zobbi et al | 156/637 |
| 4,803,058 | 2/1989 | Highfill | 252/135 |
| 4,818,333 | 4/1989 | Michaud | 156/682-- |

Signed and Sealed this

Twenty-eighth Day of December, 1993

Bruce Lehman

*Attest:*

BRUCE LEHMAN

*Attesting Officer*

*Commissioner of Patents and Trademarks*